US009053888B2

(12) United States Patent
Kim et al.

(10) Patent No.: US 9,053,888 B2
(45) Date of Patent: Jun. 9, 2015

(54) TIE BAR FOR MOLDED CASE CIRCUIT BREAKER AND METHOD OF ASSEMBLY

(75) Inventors: Samuel Stephen Kim, West Hartford, CT (US); Jonathan Rich Doncet, Plainville, CT (US); Yatin Vilas Newase, Maharashtra (IN); Girish Hassan Mruthunjaya, Macon, GA (US)

(73) Assignee: General Electric Company, Schenectady, NY (US)

( * ) Notice: Subject to any disclaimer, the term of this patent is extended or adjusted under 35 U.S.C. 154(b) by 182 days.

(21) Appl. No.: 13/545,554

(22) Filed: Jul. 10, 2012

(65) Prior Publication Data

US 2014/0014482 A1 Jan. 16, 2014

(51) Int. Cl.

| | |
|---|---|
| ***H01H 9/02*** | (2006.01) |
| ***H01H 19/04*** | (2006.01) |
| ***H01H 13/04*** | (2006.01) |
| ***H01H 21/04*** | (2006.01) |
| ***H01H 71/02*** | (2006.01) |

(52) U.S. Cl.

CPC ..... *H01H 71/0257* (2013.01); *Y10T 29/49105* (2015.01); *H01H 71/025* (2013.01)

(58) Field of Classification Search

CPC ..... H01H 71/025; H01H 71/0257
USPC ..... 200/307
See application file for complete search history.

(56) References Cited

U.S. PATENT DOCUMENTS

| | | | | |
|---|---|---|---|---|
| 4,727,226 | A * | 2/1988 | Comtois et al. | 200/50.32 |
| 5,898,146 | A | 4/1999 | Beck et al. | |
| 6,064,018 | A | 5/2000 | Seymour et al. | |
| 7,633,365 | B2 | 12/2009 | Harmon et al. | |
| 8,378,243 | B2 * | 2/2013 | Ahlert et al. | 200/293 |
| 8,604,366 | B2 * | 12/2013 | Bower et al. | 200/5 B |
| 8,748,764 | B2 * | 6/2014 | Ahlert et al. | 200/293 |

* cited by examiner

*Primary Examiner* — Renee S Luebke
*Assistant Examiner* — Lheiren Mae A Caroc
(74) *Attorney, Agent, or Firm* — General Electric Company

(57) ABSTRACT

A molded case circuit breaker is provided. The molded case circuit breaker includes a molded base defining at least one cavity and a tie bar coupled to the molded base and extending across the cavity. The tie bar is configured to reduce fracture and separation of the molded base during a high pressure event.

17 Claims, 5 Drawing Sheets

TIE BAR FOR MOLDED CASE CIRCUIT BREAKER AND METHOD OF ASSEMBLY

BACKGROUND OF THE INVENTION

The field of the invention relates generally to circuit breakers and, more particularly, to molded case circuit breakers.

A circuit breaker is an automatically operated electrical switch designed to protect an electrical circuit from damage caused by overloaded or shorted circuits. Circuit breakers are installed in electrical distribution circuits to provide protection against high currents produced by various overcurrent conditions such as short-circuits, ground faults, overloads, etc. High pressures created within the circuit breaker during these events can damage or fracture the circuit breakers and expose electrical components that can injure a person.

BRIEF DESCRIPTION OF THE INVENTION

In one embodiment, a molded case circuit breaker is provided. The molded case circuit breaker includes a molded base defining at least one cavity and a tie bar coupled to the molded base and extending across the cavity. The tie bar is configured to reduce fracture and separation of the molded base during a high pressure event.

In another embodiment, a tie bar for a molded case circuit breaker is provided. The tie bar includes a body comprising first and second opposed end portions. The tie bar is configured to extend across a cavity of the molded case circuit breaker having first and second sidewalls formed therein. The first end portion is configured to be coupled to the first sidewall and the second end portion is configured to be coupled to the second sidewall. The tie bar is configured to prevent the first and second sidewalls from separating during a high pressure event in the molded case circuit breaker.

In yet another embodiment, a method of assembling a molded case circuit breaker is provided. The method includes providing a circuit breaker housing having at least one cavity therein and coupling a tie bar to the housing such that the tie bar extends across the at least one cavity.

DETAILED DESCRIPTION OF THE INVENTION

Figure 1:
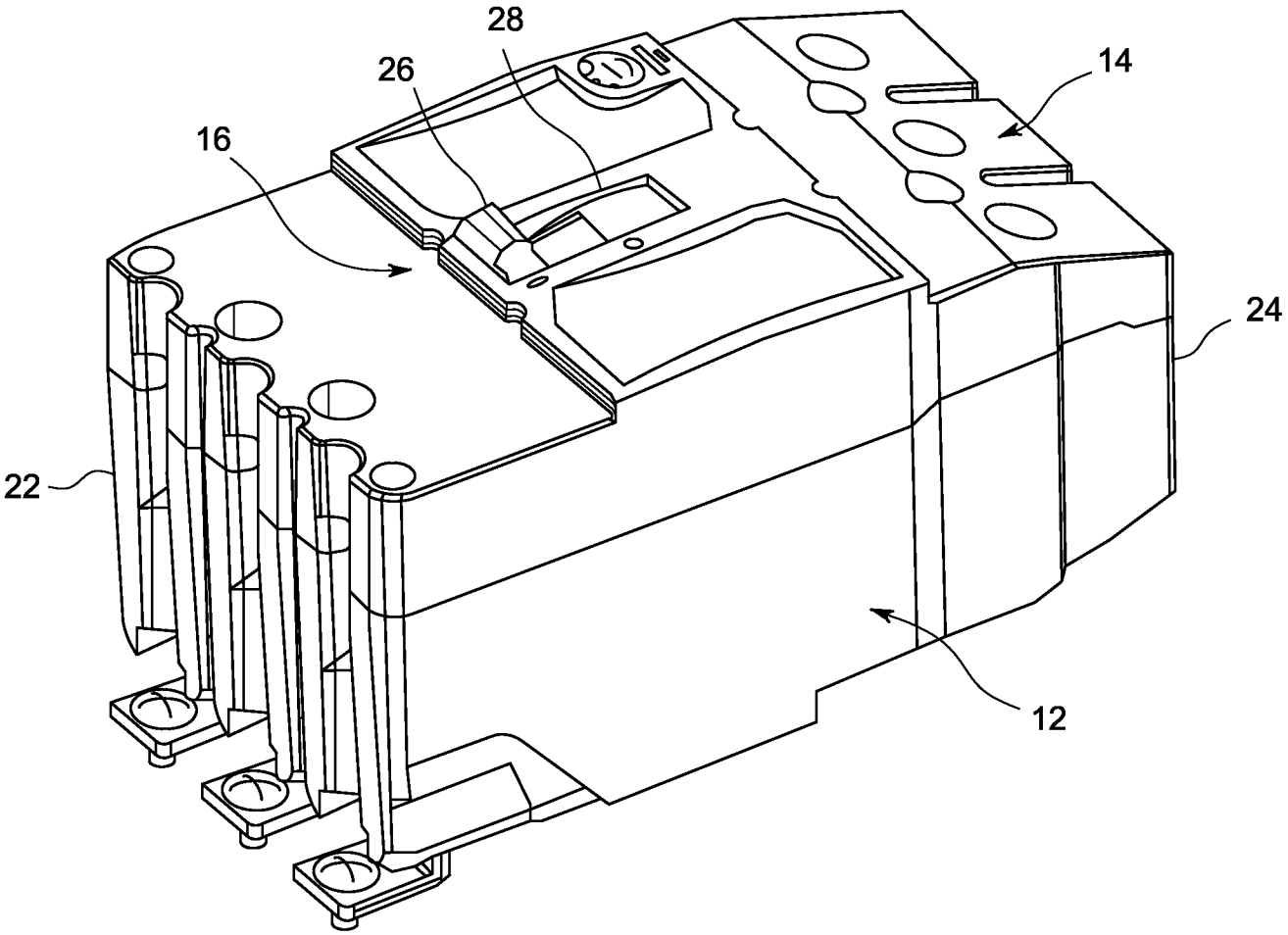
FIG. 1 is a perspective view of an exemplary circuit breaker.

FIG. 1 illustrates an exemplary embodiment of a circuit breaker 10, such as a molded case circuit breaker, for example. Generally, the exemplary molded case circuit breaker 10 comprises a molded base 12, a cover 14, an operating mechanism 16, contacts 18 (shown in FIG. 3), and a tie bar 20 (shown in FIG. 4). The molded case circuit breaker 10 is a three-pole breaker. However, circuit breaker 10 may have any number of poles and may be, for example, a two-pole or four-pole breaker. Molded case circuit breaker 10 is generally interconnected within a protected circuit between multiple phases of a power source (not shown) at a line end 22 and a load to be protected (not shown) at a load end 24. A circuit breaker operating handle 26 extends through an opening 28 for manual operation to turn the circuit breaker between its "on" and "off" conditions.

Figure 2:
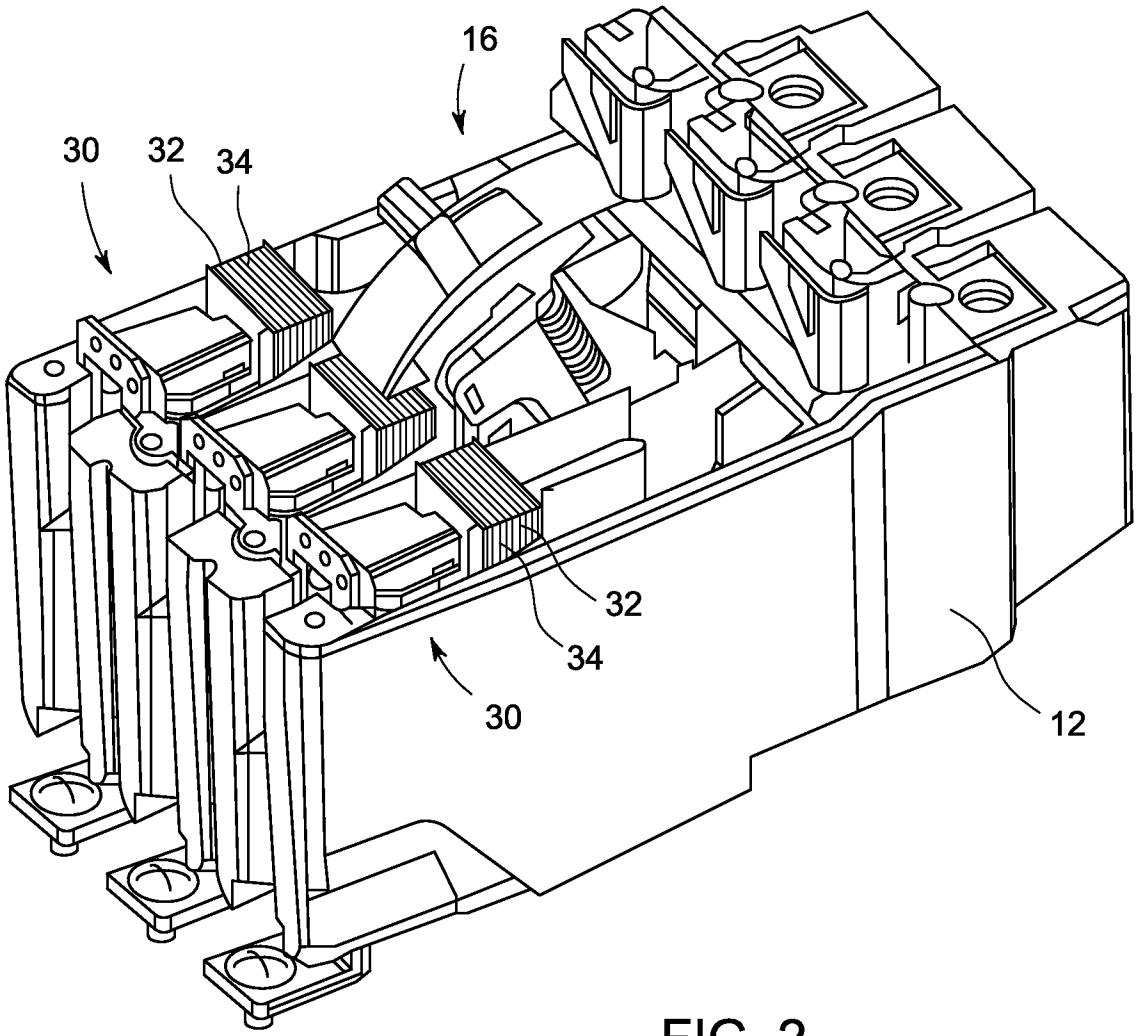
FIG. 2 is a perspective view of the circuit breaker of FIG. 1 with a cover removed.

FIG. 2 illustrates circuit breaker 10 with cover 14 removed. In the exemplary embodiment, circuit breaker 10 houses arc chutes 30 that each comprise a plurality of metal plates 32 stacked together by insulating sheets 34. When circuit breaker 10 interrupts current flow, an arc is generated. Each arc chute 30 is configured to confine and divide the arc to extinguish it.

Figure 3:
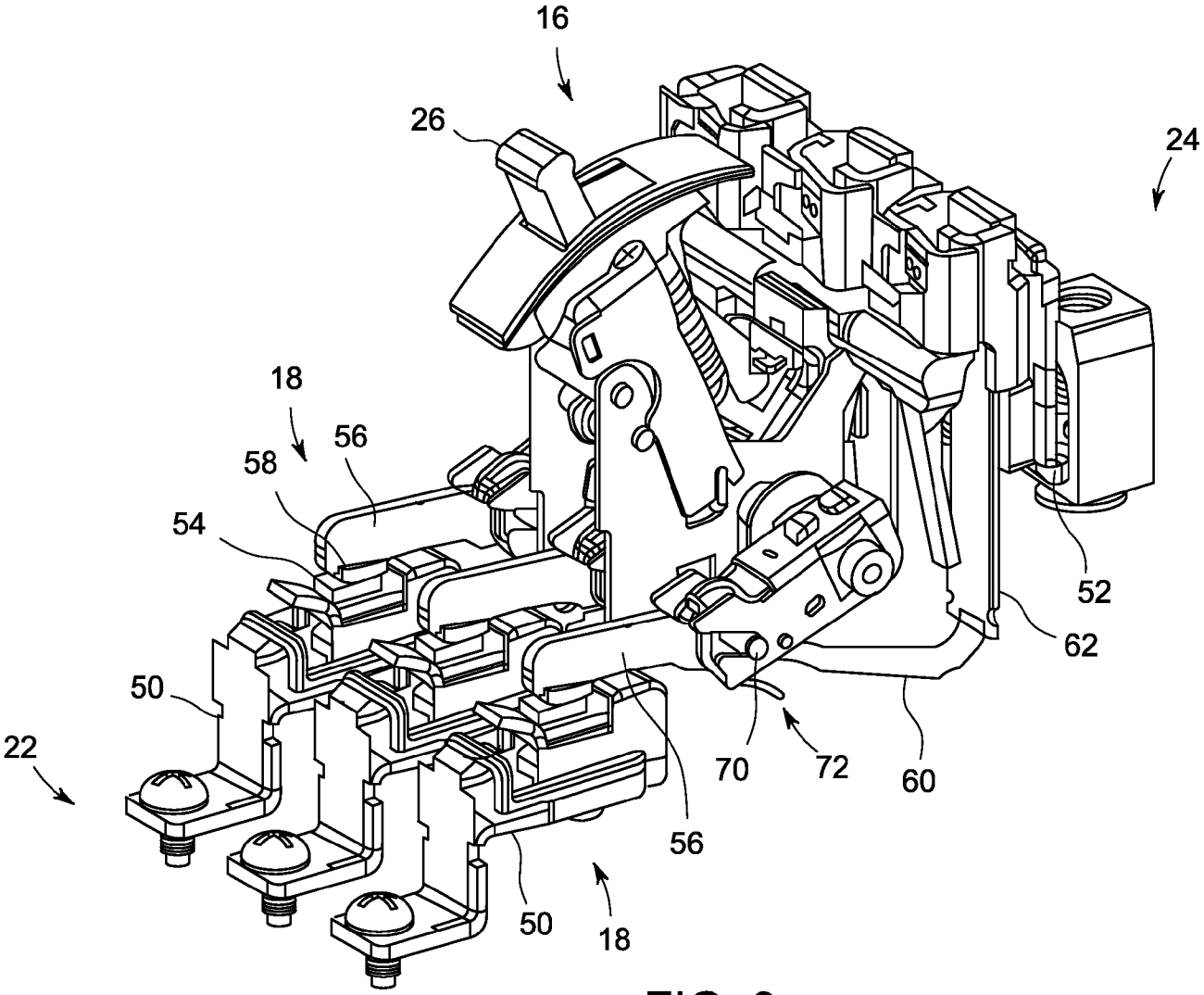
FIG. 3 is a perspective view of exemplary contacts and an operating mechanism of the circuit breaker of FIGS. 1 and 2.

FIG. 3 illustrates an exemplary embodiment of operating mechanism 16 and contacts 18 of molded case circuit breaker 10. Molded case circuit breaker 10 includes a set of contacts 18 for each pole of the system. Circuit breaker 10 includes three contacts 18 operatively connected to operating mechanism 16. Each contact 18 includes a line terminal 50, a load terminal 52, a fixed contact 54 and a movable contact arm 56 having a movable contact 58. Line terminal 50 is electrically connected to line end 22 and load terminal 52 is electrically connected to load end 24. In the exemplary embodiment, fixed contact 54 is coupled to line terminal 50 and movable contact arm 56 is electrically connected to load terminal 52 via copper braid 60 and bimetal 62. Movable contact arm 56 is depicted in FIG. 3 in the "on" position such that movable contact 58 is in physical and electrical contact with fixed contact 54, thereby defining a current path (not shown) between line terminal 50 and load terminal 52.

In the exemplary embodiment, movable contact arm 56 may be moved between "on" and "off" positions by operating mechanism 16. A crossbar 70 interconnects operating mechanism 16 with each movable contact arm 56 to ensure movable contact arms 56 rotate about a pivot 72 simultaneously when operating mechanism 16 is actuated. Further, each movable contact arm 56 moves from the "on" position to the "off" position in response to a trip event, such as a short circuit, or a current that exceeds a defined level for a defined time, for example. As previously described, arc chutes 30 are configured to extinguish arcs that may be created during the trip event.

Figure 4:
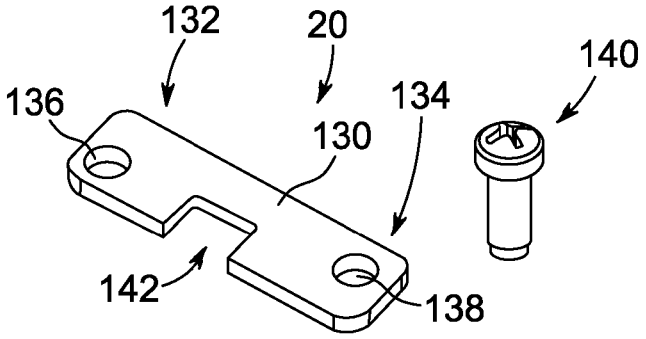
FIG. 4 is a perspective view of an exemplary tie bar of the circuit breaker of FIG. 1.

FIG. 4 illustrates an exemplary embodiment of tie bar 20 that comprises a generally rectangular body 130 having a first portion 132 and a second portion 134. Although body 130 is described as rectangular, body 130 may be any shape enabling circuit breaker 10 to function as described herein. Tie bar 20 is fabricated from sheet metal, for example steel, however tie bar 20 may be fabricated from any suitable material enabling circuit breaker 10 to function as described herein. Body 130 includes a notched portion 142 to provide clearance to components in circuit breaker 10, such as, for example, movable contact arm 56. Further, first and second portions 132 and 134 include apertures 136 and 138 therethrough, respectively. Apertures 136 and 138 each receive a fastener 140 to facilitate coupling tie bar 20 to molded base 12, as described below.

Figure 5:
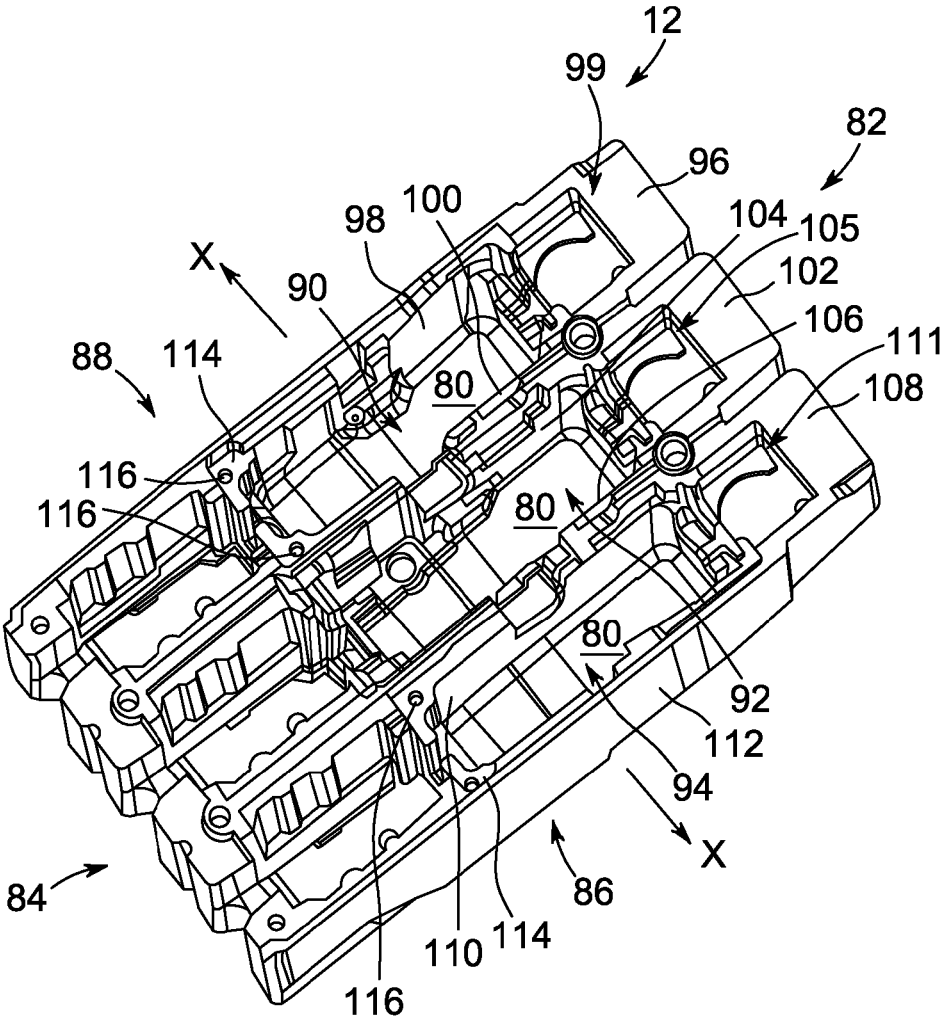
FIG. 5 is a perspective view of a molded base of the circuit breaker of FIG. 1.

FIG. 5 illustrates an exemplary embodiment of molded base 12 into which operating mechanism 16 and contacts 18 are disposed. Molded base 12 generally includes an interior bottom surface 80, a top end 82, a bottom end 84, and two sides 86 and 88. Molded base 12 is a molded base fabricated from thermoplastic. In other embodiments, molded base 12 is fabricated from any suitable material, such as, for example, glass polyester, thermoset resin, or other material having a high dielectric strength.

In the exemplary embodiment, circuit breaker 10 is a three-pole circuit breaker having three cavities 90, 92 and 94. Each contact 18 is disposed in a respective cavity 90, 92 and 94. Cavity 90 is defined by sidewalls 98 and 100 and a linking wall 99 that is substantially orthogonal to and couples sidewalls 98 and 100, for example, top wall 96 and/or bottom surface 80. Cavity 92 is defined by sidewalls 104 and 106 and a linking wall 105, for example, top wall 102 and/or bottom surface 80. Cavity 94 is defined by sidewalls 110 and 112 and a linking wall 111, for example, top wall 108 and/or bottom surface 80.

In the exemplary embodiment, side walls 98, 100, 110 and 112 have a recess 114 formed therein. Although not shown, side walls 104 and 106 may also have a recess 114 formed therein. Each recess 114 is shaped to accept tie bar 20 and includes aperture 116. Tie bar 20 extends across cavities 90 and 94 (see FIG. 6) and is configured to couple adjacent sidewalls together to increase the strength of molded base 12 to withstand pressures generated during short circuit events such as repulsion forces X. Recess 114 is provided for ease of assembly of tie bar 20 to molded base 12. In alternative embodiments, recess 114 is not included. Although not shown, tie bar 20 may also extend across cavity 92.

Figure 6:
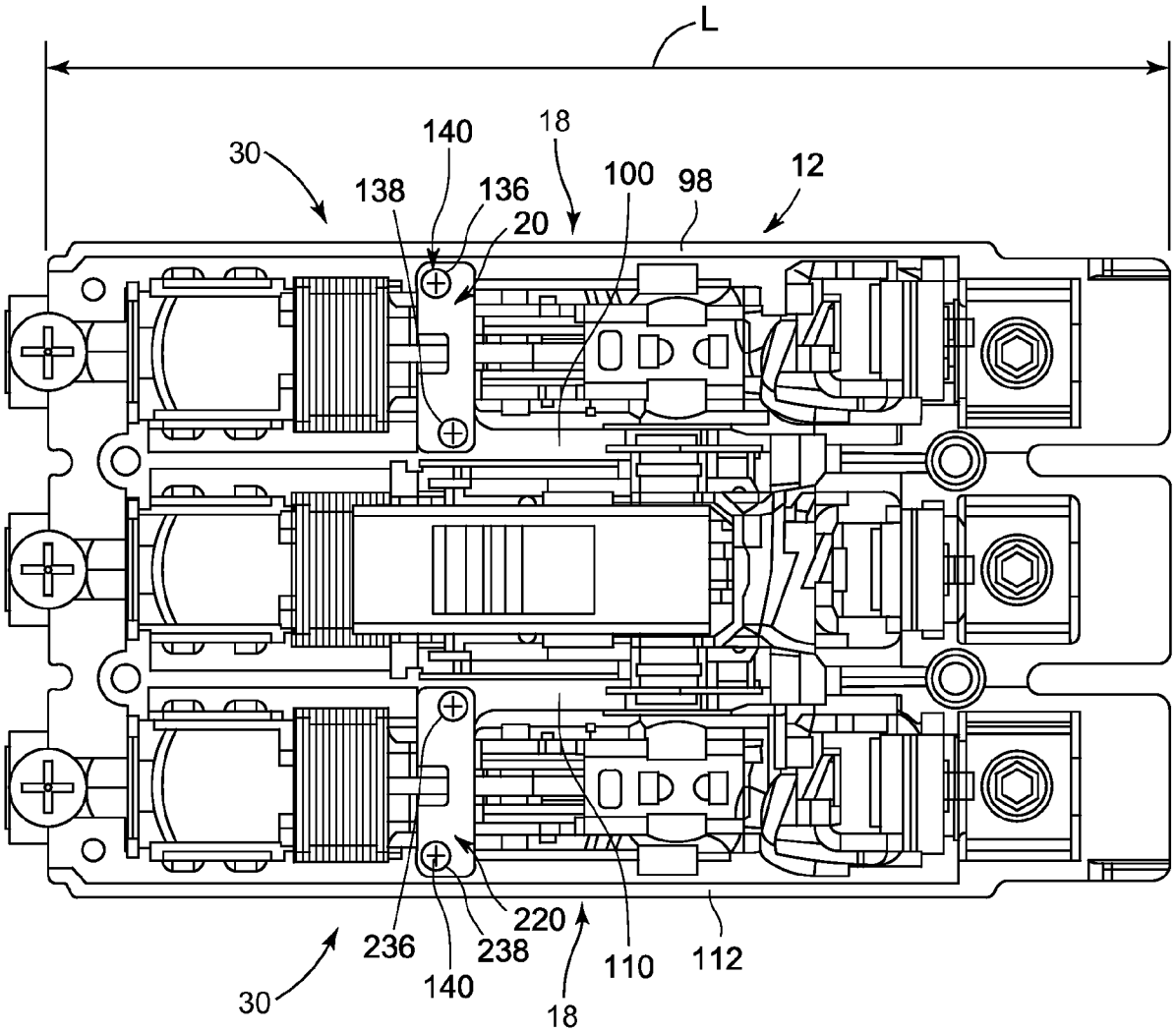
FIG. 6 is a top view of a molded case circuit breaker with the tie bar of FIG. 4.

FIG. 6 illustrates an exemplary embodiment of tie bar 20 installed with molded base 12. Tie bar 20 is positioned substantially orthogonal to sidewalls 98 and 100, sidewalls 104 and 106, and/or sidewalls 110 and 112. Apertures 136 and 138 of a first tie bar 20 are aligned with a first pair of apertures 116 formed in molded base 12. A first fastener 140 extends through apertures 136 and 116, and a second fastener 140 extends through apertures 138 and 116, to couple first tie bar 20 to side walls 98 and 100. A second tie bar 220 includes apertures 236 and 238, which are aligned with a second pair of apertures 116. A third fastener 140 extends through apertures 236 and 116 and a fourth fastener 140 extends through apertures 238 and 116 to couple second tie bar 220 to side walls 110 and 112. Thus, first tie bar 20 extends across cavity 90 and second tie bar 220 extends across cavity 94. In another embodiment, an additional tie bar 20 is coupled to sidewalls 104 and 106 in a manner similar to that described above.

In the exemplary embodiment, tie bars 20 and 220 are each located between an arc chute 30 and contact 18. In the exemplary embodiment, tie bars 20 and 220 are located proximate contacts 54 and 58 where high repulsion forces X are generated, as further described. Alternatively, tie bars 20 and 220 are located anywhere along a length L of molded base 12 that enables adjacent sidewalls to be coupled together as described herein. In the exemplary embodiment, tie bars 20 and 220 are longitudinally aligned (FIG. 6) such that tie bar 20 is located in the same position along length L as tie bar 220. Alternatively, tie bars 20 and 220 are each located at different respective positions along length L.

During a short circuit trip event of multi-pole circuit breaker 10, magnetic repulsion forces X (FIG. 5) are created by high currents running parallel in each current path (not shown). Separation of contacts 54 and 58 during a trip event cause a high temperature arc of current that may change surrounding materials (not shown) from a solid state to a gaseous state. The sudden change to a gaseous state generates high pressures, i.e. repulsion forces X, which are directed generally outward from cavity 90, 92 and/or 94 and orthogonal to molded base sides 86 and 88. For example, repulsion force generated in cavity 90 is directed towards sidewall 98 and in the opposite direction towards sidewall 100.

As described above, tie bar 20 couples sidewalls 98 and 100, sidewalls 104 and 106, and/or sidewalls 110 and 112 to resist repulsion forces X that force the respective sidewalls apart resulting in fracture of molded base 12 and/or exposure of live electrical components (not shown). In the exemplary embodiment, tie bar 20 is configured to restrict and/or prevent separation of sidewalls 98, 100, 104, 106, 110 and 112 in the direction of forces X, thereby reducing the likelihood of damage or fracture to molded base 12. For example, separation of sidewalls 98 and 100 is prevented by coupling tie bar first portion 132 to sidewall 100 and coupling second portion 134 to sidewall 98. Tie bar 20 facilitates transferring at least a portion of repulsion forces X acting on sidewall 98 to sidewall 100, and vice versa. Thus, repulsion forces X are distributed between two sidewalls 98 and 100, rather than a single wall as in known systems, resulting in increased resistance to separation and/or fracture. Further, repulsion forces X acting in opposite directions through tie bar 20 tend to diminish each other, resulting in reduced force on each of sidewalls 98 and 100. Coupling tie bar 20 to sidewalls 104 and 106, and sidewalls 110 and 112 provides the same advantages.

In the exemplary embodiment, tie bar 20 provides additional strength to sidewalls 98, 100, 104, 106, 110 and 112 of molded circuit breaker 10 and resistance to pressure forces generated during a trip event. Advantageously, tie bar 20 facilitates forming molded base 12, and in particular sidewalls 98, 100, 104, 106, 110 and 112, with a reduced thickness and/or allows molded base 12 to handle greater loads, thereby increasing the compactness of molded circuit breaker 10, reducing costs, and increasing the current capacity of molded circuit breaker 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A molded case circuit breaker comprising:

a molded base comprising a first sidewall and a second sidewall at least partially defining at least one cavity; and a tie bar coupled to said molded base and extending across said cavity, said tie bar mechanically linking said first sidewall to said second sidewall, wherein said tie bar is stationary relative to said base and is configured to reduce fracture and separation of said molded base during a high pressure event by transferring and distributing loads generated during the high pressure event between said first and second sidewalls, wherein said tie bar comprises a body having a first end portion including a first aperture therethrough and a second end portion including a second aperture therethrough, said tie bar coupled to said molded base by first and second fasteners inserted through said first and second apertures, respectively.

2. The molded case circuit breaker of claim 1, wherein said molded base further comprises a first linking wall, said first and second sidewalls extending from said first linking wall, said first linking wall and said first and second sidewalls defining a first cavity, wherein the first end portion of said tie bar is coupled to said first sidewall and the second portion of said tie bar is coupled to said second sidewall.

3. The molded case circuit breaker of claim 1, wherein said molded case circuit breaker is a two-pole circuit breaker, said molded base defining first and second cavities.

4. The molded case circuit breaker of claim 3, wherein said molded base further comprises first and second linking walls and third and fourth sidewalls, said first and second sidewalls extending from said first linking wall to define said first cavity, and said third and fourth sidewalls extending from said second linking wall to define said second cavity, wherein the first end portion of said tie bar is coupled to said first sidewall and the second end portion of said tie bar is coupled to said second sidewall.

5. The molded case circuit breaker of claim 1, wherein said molded case circuit breaker is a three-pole circuit breaker, said molded base defining first, second and third cavities.

6. The molded case circuit breaker of claim 5, wherein said first cavity is defined by a first linking wall and said first and second sidewalls, said first and second sidewalls extending from said first linking wall, said second cavity is defined by a second linking wall and third and fourth sidewalls extending therefrom, and said third cavity is defined by a third linking wall and fifth and sixth sidewalls extending therefrom, wherein the first end portion of said tie bar is coupled to said first sidewall and the second end portion of said tie bar is coupled to said second sidewall.

7. The molded case circuit breaker of claim 6, further comprising a second tie bar, wherein a first portion of said second tie bar is coupled to said fifth sidewall and a second portion of said second tie bar is coupled to said sixth sidewall.

8. The molded case circuit breaker of claim 1, wherein said at least one cavity contains a fixed contact and a movable contact arranged for connection with an external circuit, said movable contact coupled to one end of a movable contact arm.

9. The molded case circuit breaker of claim 8 further comprising an operating mechanism within said molded base, said operating mechanism configured to move said movable contact arm and said movable contact to automatically interrupt current through said circuit upon occurrence of an overcurrent condition.

10. The molded case circuit breaker of claim 9 further comprising an operating handle externally accessible through a cover of said molded case circuit breaker and operatively connected to said operating mechanism, said operating handle configured to move said movable contact arm and said movable contact between on and off positions.

11. The molded case circuit breaker of claim 1, wherein said tie bar comprises sheet metal.

12. The molded case circuit breaker of claim 1, wherein said molded base comprises a recess to accept said tie bar.

13. A tie bar for a molded case circuit breaker including a base having a first sidewall and a second sidewall, said tie bar comprising:

a body comprising first and second opposed end portions, said tie bar configured to extend across a cavity of said molded case circuit breaker having the first and second sidewalls formed therein, said first end portion configured to be coupled to said first sidewall and said second end portion configured to be coupled to said second sidewall, wherein said tie bar is configured to mechanically link the first sidewall to the second sidewall and remain stationary relative to the base, said tie bar further configured to prevent said first and second sidewalls from separating during a high pressure event in said molded case circuit breaker by transferring and distributing loads generated during the high pressure event between the first and second sidewalls, wherein said tie bar further comprises a first aperture in said first end portion and a second aperture in said second end portion, said tie bar configured to be coupled to said first and second sidewalls with a first fastener inserted through said first aperture and a second fastener inserted through said second aperture.

14. The tie bar of claim 13, wherein said body further comprises sheet metal.

15. The tie bar of claim 13, wherein said body further comprises a notched portion configured to allow clearance of a movable contact arm of said molded case circuit breaker.

16. A method of assembling a molded case circuit breaker comprising:

providing a molded base having a first sidewall and a second sidewall at least partially defining at least one cavity therein; and coupling a tie bar to the molded base such that the tie bar is stationary relative to the base, extends across the at least one cavity, and mechanically links the first sidewall to the second sidewall, the tie bar configured to transfer and distribute loads generated during a high pressure event between the first and second sidewalls, wherein the tie bar comprises a body having a first end portion including a first aperture therethrough and a second end portion including a second aperture therethrough, the tie bar coupled to the molded base by first and second fasteners inserted through the first and second apertures, respectively.

17. The method of claim 16, wherein said molded base comprises a first linking wall, the first and second sidewalls extending from the first linking wall, the first linking wall and the first and second sidewalls defining a first cavity, wherein said coupling step comprises:

coupling the first end portion of the tie bar to the first sidewall of the cavity; and coupling the second end portion of the tie bar to the second sidewall of the cavity, wherein the tie bar extends across the cavity.

* * * * *